US008904971B2

(12) United States Patent
Huang et al.

(10) Patent No.: US 8,904,971 B2
(45) Date of Patent: Dec. 9, 2014

(54) METHOD OF CONTROLLING COMBUSTION OF GAS APPLIANCE

(75) Inventors: Chung-Chin Huang, Taichung (TW); Chin-Ying Huang, Taichung (TW); Hsin-Ming Huang, Taichung (TW); Hsing-Hsiung Huang, Taichung (TW)

(73) Assignee: Grand Mate Co., Ltd, Taichung (TW)

( * ) Notice: Subject to any disclaimer, the term of this patent is extended or adjusted under 35 U.S.C. 154(b) by 477 days.

(21) Appl. No.: 13/308,676

(22) Filed: Dec. 1, 2011

(65) Prior Publication Data

US 2013/0139765 A1 Jun. 6, 2013

(51) Int. Cl.
*F24H 1/18* (2006.01)

(52) U.S. Cl.
USPC ..... 122/14.21; 122/14.3; 126/351.1; 431/12

(58) Field of Classification Search
CPC ..... C01B 2203/1695; H01M 8/04022; H01M 8/04492; H01M 8/0432; F01N 2560/00; F01N 2900/14; F01N 2900/1402; F01N 2240/14; F01N 2560/02; F23D 14/28; F23R 3/28; F23N 5/003
USPC ..... 122/14.1, 14.2, 14.21, 14.3; 431/2, 6, 431/12; 126/350.1, 351.1
See application file for complete search history.

(56) References Cited

U.S. PATENT DOCUMENTS

| | | | | |
|---|---|---|---|---|
| 4,832,818 | A * | 5/1989 | Sekido et al. | 204/412 |
| 5,037,291 | A * | 8/1991 | Clark | 431/12 |
| 5,121,880 | A * | 6/1992 | Adams et al. | 237/12 |
| 5,632,614 | A * | 5/1997 | Consadori et al. | 431/79 |
| 6,694,926 | B2 * | 2/2004 | Baese et al. | 122/14.2 |
| 6,881,055 | B2 * | 4/2005 | Bird | 431/80 |
| 8,333,584 | B2 * | 12/2012 | Cook | 431/6 |
| 8,521,400 | B2 * | 8/2013 | Yamashita et al. | 701/103 |
| 2005/0274328 | A1 * | 12/2005 | Baese et al. | 122/14.1 |
| 2011/0070550 | A1 * | 3/2011 | Arensmeier | 431/12 |
| 2011/0077874 | A1 * | 3/2011 | Honda et al. | 702/45 |
| 2012/0226424 | A1 * | 9/2012 | Adams | 701/93 |

* cited by examiner

*Primary Examiner* — Gregory A Wilson
(74) *Attorney, Agent, or Firm* — Tracy M. Heims; Apex Juris, pllc

(57) ABSTRACT

A method of controlling combustion of a gas appliance includes the following steps: a) Read a first burning data in a database; b) Burn gas according to the first burning data; c) Obtain a burning efficiency of the gas appliance; and d) Compare the burning efficiency with a predetermined value, and repeat the step b to the step d when the burning efficiency is higher than the value, or read a second burning data in the database and burn gas according to the second burning data when the burning efficiency is lower than the value. The present invention provides plural stages of burning according to the main component of the gas to be burned to increase the total burning efficiency.

10 Claims, 3 Drawing Sheets

METHOD OF CONTROLLING COMBUSTION OF GAS APPLIANCE

BACKGROUND OF THE INVENTION

1. Field of the Invention

The present invention relates generally to a gas appliance, and more particularly to a method of controlling combustion of a gas appliance.

2. Description of the Related Art

Gas appliances, such as water heater, gas stove, and fireplace, are very popular in ordinary home life. For a safety operation, more and more safety apparatus or automatic control systems for the gas appliance are provided in the market to increase the burning efficiency when some problems occurs in the system, such as machine aging, unstable gas supply, and insufficient air.

Liquified petroleum gas is one of the popular gas supplies for the gas appliance. It mainly contains two components, propane and butane. Butane is heavier than propane that butane usually sinks to a bottom of the gas tank. Therefore, the gas appliance burns butane after propane. In other words, the fuel to be burned is different for a full gas tank and a near empty gas tank. However, the conventional gas appliance usually takes the gas in the gas tank is the same that the gas appliance never get its best burning efficiency. For example, some gas appliances take propane for the main fuel to be burned that the burning efficiency will gradually reduce as the gas burned out. It is the same when the gas appliance takes butane for the main fuel to be burned. Therefore, it still has some issues to be improved to increase the burning efficiency of the gas appliances.

SUMMARY OF THE INVENTION

The primary objective of the present invention is to provide a method of controlling combustion of a gas appliance, which may change air-fuel ratio or water according the components of the gas supply to increase the burning efficiency.

According to the objective of the present invention, a method of controlling combustion of a gas appliance includes the following steps:

a) Read a first burning data in a database;

b) Burn gas according to the first burning data;

c) Obtain a burning efficiency of the gas appliance; and d) Compare the burning efficiency with a predetermined value, and repeat the step b to the step d when the burning efficiency is higher than the value, or read a second burning data in the database and burn gas according to the second burning data when the burning efficiency is lower than the value.

In an embodiment, the first burning data includes a first air-fuel ratio that a flow rate of the gas to be burned is adjusted to meet the first air-fuel ratio in the step b.

In an embodiment, the second burning data includes a second air-fuel ratio that a flow rate of the gas to be burned is adjusted to meet the second air-fuel ratio in the step d.

In an embodiment, the first burning data includes a first air-fuel ratio that a flow rate of air to be mixed with the gas is adjusted to meet the first air-fuel ratio in the step b.

In an embodiment, the second burning data includes a second air-fuel ratio that a flow rate of air to be mixed with the gas is adjusted to meet the second air-fuel ratio in the step d.

In an embodiment, the first burning data includes a first water supply index that a flow rate of water to be heated is adjusted to meet the first water supply index in the step b.

In an embodiment, the second burning data includes a second water supply index that a flow rate of water to be heated is adjusted to meet the second water supply index in the step d.

In an embodiment, the burning efficiency is calculated from a concentration of carbon dioxide after burning.

In an embodiment, the burning efficiency is calculated from a water temperature difference before and after burning and a heat provided by the gas appliance.

Therefore, the conditions of burning may be changed by changing the gas flow rate, the air flow rate, or the water flow rate, according to the types of gases to be burned to increase the total burning efficiency.

DETAILED DESCRIPTION OF THE INVENTION

Figure 1:
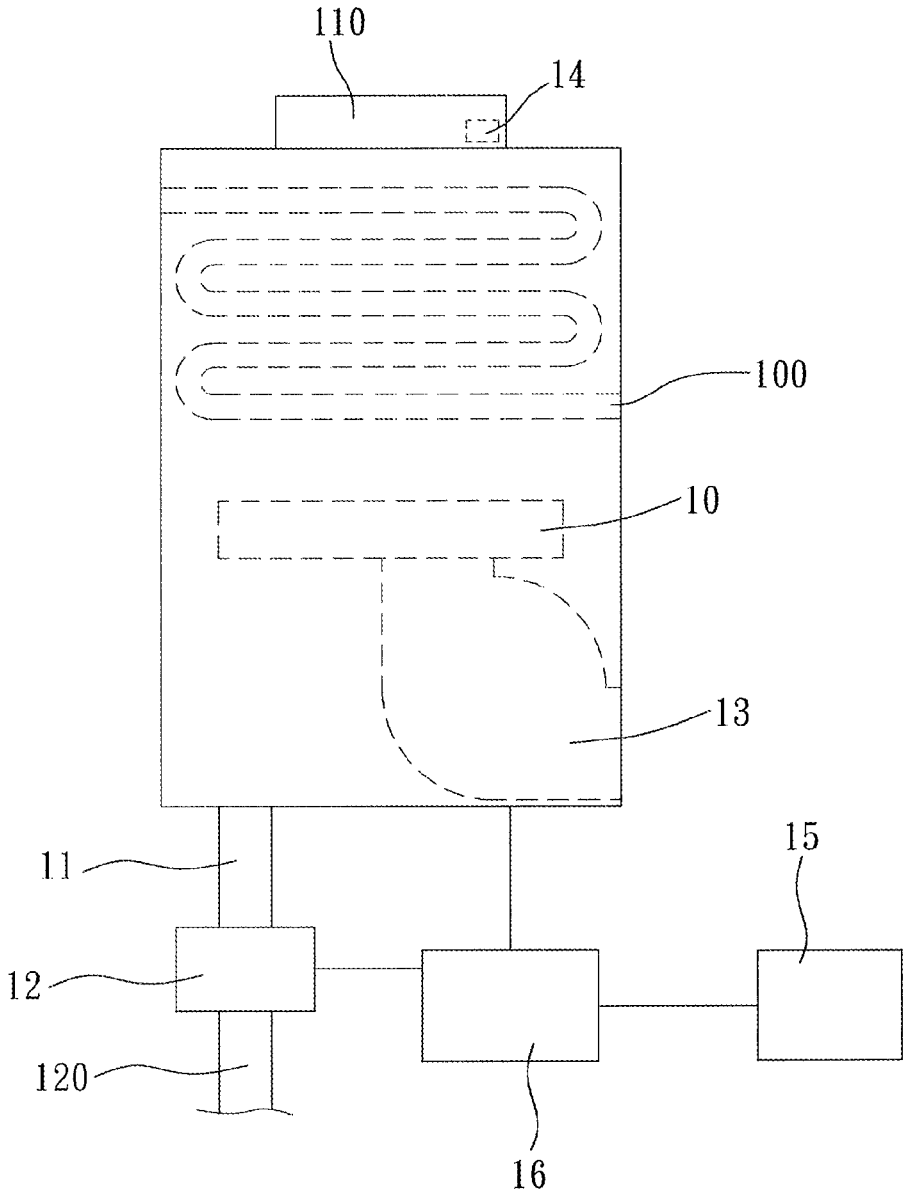
FIG. 1 is a sketch diagram of the gas appliance.
Figure 2:
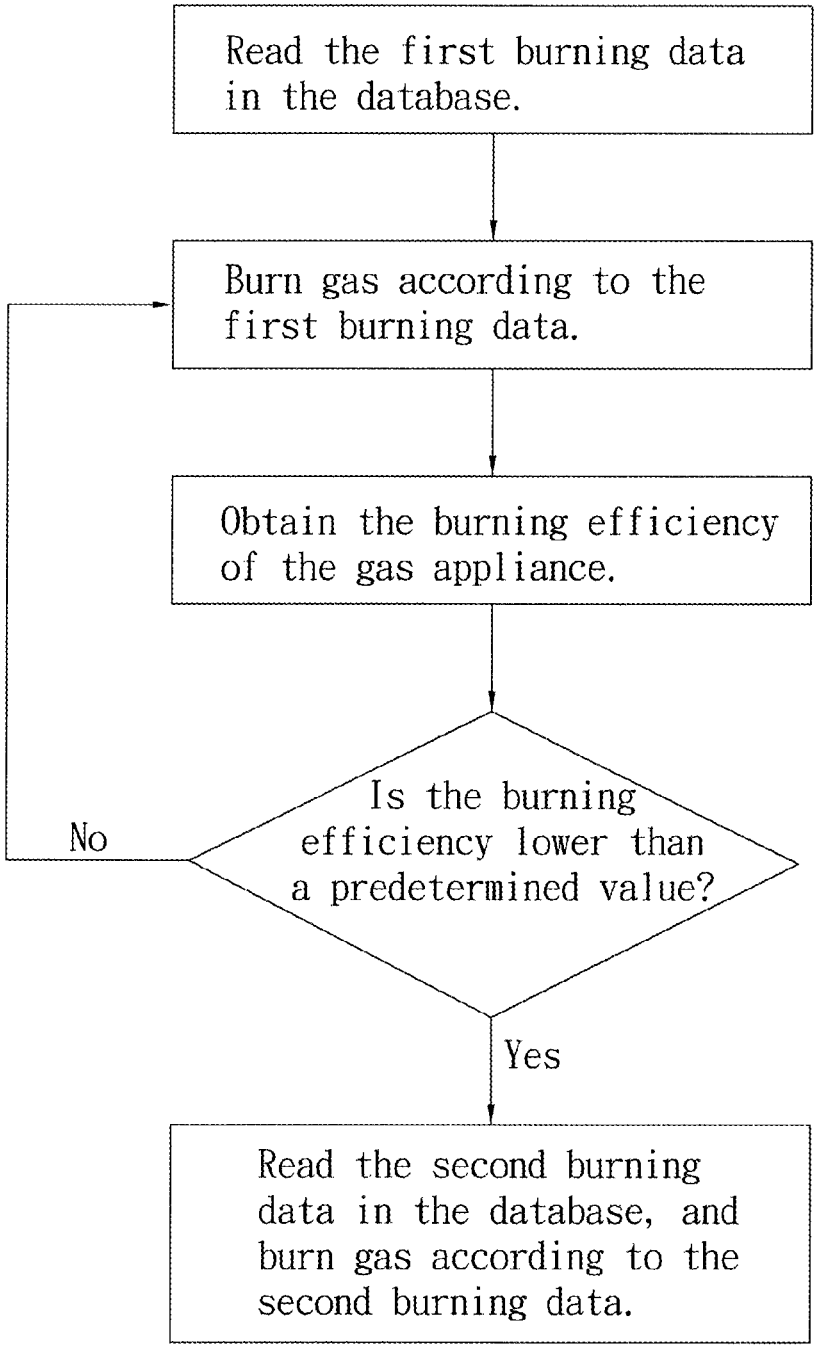
FIG. 2 is a flow chart of the method of the preferred embodiment of the present invention.

FIG. 1 shows a gas appliance applied in a method of the first preferred embodiment of the present invention. The gas appliance is a power vent water heater, including a combustor 10, a gas pipe 11, a gas controller 12, a blower 13, a sensor 14, a storage device 15, and a main controller 16.

The combustor 10 is under a water pipe 100 to heat water in the water pipe 100. The waste gas of the combustor 10 is exhausted out through an exhausting pipe 110.

The gas pipe 11 is connected to a pipe 120 of a gas tank (not shown) to supply the combustor 10 gas.

The gas controller 12 is a ratio valve in the present invention connected to the gas pipe 11 to adjust a flow rate of gas supplied to the combustor 10. The ratio valve may use the device taught in U.S. patent publication no. 2009020629 which is operated by current to adjust the flow rate. Of course, any device that may adjust the flow rate may be incorporated in the present invention.

The blower 13 is under the combustor 10 to supply air to be mixed with gas. It is known that the speed of the blower 13 is positive proportional to a flow rate of air.

The sensor 14 is a carbon dioxide sensor in the present invention on the exhausting pipe 110 to sense a concentration of carbon dioxide after burning.

The storage device 15 is stored with a database therein. The database includes a first burning data and a second burning data. The first burning data has a first air-fuel ratio for a first gas, such as propane, and the second burning data has a second air-fuel ratio for a second gas, such as butane.

The main controller 16 electrically connects the gas controller 12, the blower 13, the sensor 14, and the storage device 15 to control them by the following steps:

A. Read the first burning data in the database.

B. Burn gas in a condition according to the first burning data. In the present invention, the main controller 16 controls the gas controller 12 and/or the blower 13 to supply the combustor 10 gas and air in a predetermined ratio according to the first air-fuel ratio of the first burning data.

C. Obtain a burning efficiency of the gas appliance. In the present invention, the burning efficiency is calculated by a concentration of carbon dioxide sensed by the sensor 14 and the humidity after burning. Take propane for example, chemical equation of burning propane is $$C_3H_8+5O_2 \rightarrow 4H_2O+3CO_2$$

Water and carbon dioxide will appear after propane is burned that we can estimate whether propane is complete combustion and the burning efficiency by the concentration of carbon dioxide in the exhausting pipe 110.

D. Compare the burning efficiency with a predetermined value, and then repeat the step B to step D when the burning efficiency is higher than the value, or read the second burning data in the database, and burn gas in a condition according to the second burning data when the burning efficiency is lower than the value. When the burning efficiency is lower than the value, it indicates that the first gas (propane) in the gas tank is almost out, and the second gas (butane) becomes the main to be burned.

In the present invention, the second burning data includes the second air-fuel ratio for the second gas (butane) that the gas controller 12 may be adjusted to supply the combustor 10 a predetermined gas flow to meet the second air-fuel ratio, or the blower 13 may be adjusted to supply the combustor 10 a predetermined air flow, or the gas controller 12 and the blower 13 are adjusted at the same time.

In conclusion, the foundations of burning will be changed according to the burning efficiency to keep the burning efficiency in a high level all the time.

Figure 3:
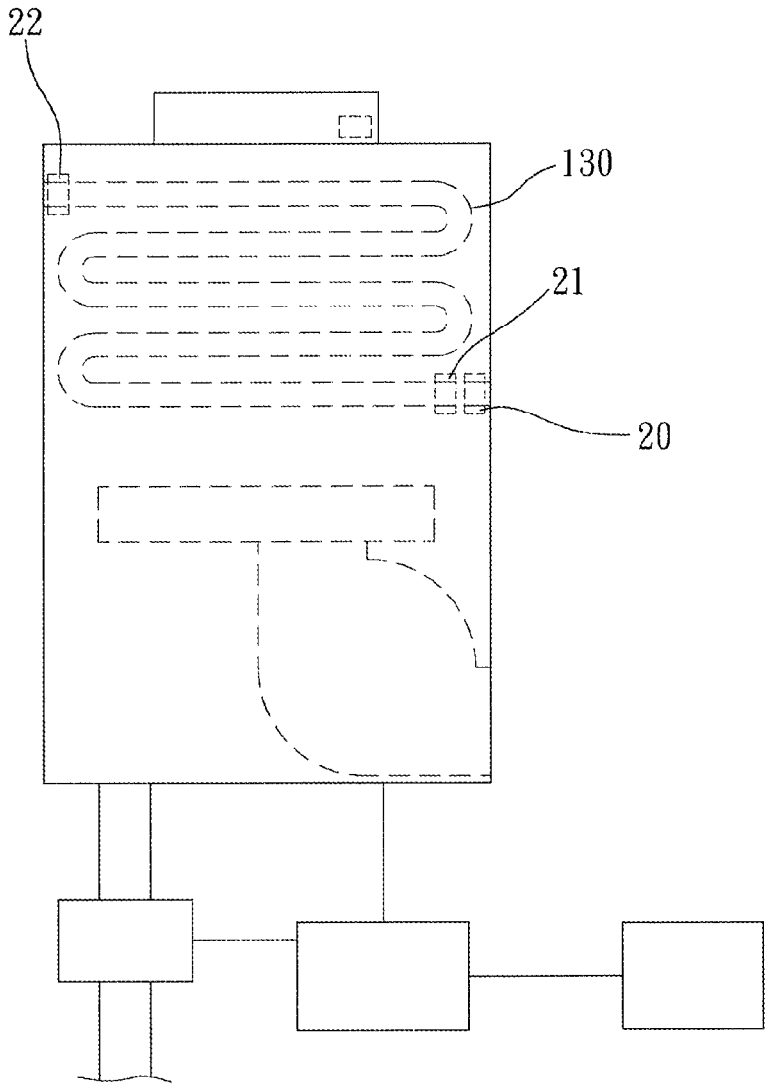
FIG. 3 is a sketch diagram of another gas appliance.

FIG. 3 shows another gas appliance to be controlled by a method of the second preferred embodiment of the present invention. The gas appliance is a power vent water heater as well. The gas appliance has the same elements as above, and further includes a water controller 20, a water input sensor 21, and a water output sensor 22. The burning data include water supply indexes for different gases. The water controller 20 is provided at an inlet of a water pipe 130 to adjust a flow rate of water in the water pipe 130. The water input sensor 21 is provided at the inlet of the water pipe 130, and the water output sensor 22 is provided at an outlet of the water pipe 130 to sense water temperatures before heating and after heating.

The method of controlling combustion of the gas appliance of the second preferred embodiment of the present invention includes the following steps:

A. Read a first burning data in the database;

B. Burn gas in a condition according to the first burning data, which means that the water controller 20 is adjusted to supply a predetermined water flow in the water pipe 30 to be heated by the combustor.

C. Obtain a burning efficiency of the gas appliance. In the present invention, the burning efficiency is calculated from a difference of an output water temperature (detected by the water output sensor 22) and an input water temperature (detected by the water input sensor 21), and the heat provided by the combustor.

D. Compare the burning efficiency with a predetermined value, and then repeat the step B to step D when the burning efficiency is higher than the value, or read a second burning data in the database, and burn gas in a condition according to the second burning data when the burning efficiency is lower than the value.

The second preferred embodiment of the present invention provides two stages of burning by changing the flow rate of water to be heated according to the type of the gas to be burned in the gas tank to increase the total burning efficiency.

In addition, the present invention provides two stages of burning, the first burning data and the second burning data. It is easy to understand that it may provide three or more stages of burning as if there are different gases in the gas tank.

The description above is just a few preferred embodiments of the present invention and the equivalence of the present invention is still in the scope of the claim of the present invention.

What is claimed is:

1. A method of controlling combustion of a gas appliance, comprising the steps of:

a) reading a first burning data in a database;

b) burning gas according to the first burning data;

c) obtaining a burning efficiency of the gas appliance; and d) comparing the burning efficiency with a predetermined value, and repeating the step b to the step d when the burning efficiency is higher than the value, or reading a second burning data in the database and burning gas according to the second burning data when the burning efficiency is lower than the value;

wherein the first burning data includes a first water supply index that a flow rate of water to be heated is adjusted to meet the first water supply index in the step b;

wherein the second burning data includes a second water supply index that the flow rate of water to be heated is adjusted to meet the second water supply index in the step d;

wherein the burning efficiency is calculated from a concentration of carbon dioxide after burning.

2. The method as defined in claim 1, wherein the first burning data includes a first air-fuel ratio that a flow rate of the gas is adjusted to meet the first air-fuel ratio in the step b.

3. The method as defined in claim 1, wherein the second burning data includes a second air-fuel ratio that a flow rate of the gas is adjusted to meet the second air-fuel ratio in the step d.

4. The method as defined in claim 1, wherein the first burning data includes a first air-fuel ratio that a flow rate of air to be mixed with the gas is adjusted to meet the first air-fuel ratio in the step b.

5. The method as defined in claim 1, wherein the second burning data includes a second air-fuel ratio that a flow rate of air to be mixed with the gas is adjusted to meet the second air-fuel ratio in the step d.

6. A method of controlling combustion of a gas appliance, comprising the steps of:

a) reading a first burning data in a database;

b) burning gas according to the first burning data;

c) obtaining a burning efficiency of the gas appliance; and d) comparing the burning efficiency with a predetermined value, and repeating the step b to the step d when the burning efficiency is higher than the value, or reading a second burning data in the database and burning gas according to the second burning data when the burning efficiency is lower than the value;

wherein the first burning data includes a first water supply index that a flow rate of water to be heated is adjusted to meet the first water supply index in the step b;

wherein the second burning data includes a second water supply index that the flow rate of water to be heated is adjusted to meet the second water supply index in the step d;

wherein the burning efficiency is calculated from a water temperature difference before and after burning and a heat provided by the gas appliance.

7. The method as defined in claim 6, wherein the first burning data includes a first air-fuel ratio that a flow rate of the gas is adjusted to meet the first air-fuel ratio in the step b.

8. The method as defined in claim 6, wherein the second burning data includes a second air-fuel ratio that a flow rate of the gas is adjusted to meet the second air-fuel ratio in the step d.

9. The method as defined in claim 6, wherein the first burning data includes a first air-fuel ratio that a flow rate of air to be mixed with the gas is adjusted to meet the first air-fuel ratio in the step b.

10. The method as defined in claim 6, wherein the second burning data includes a second air-fuel ratio that a flow rate of air to be mixed with the gas is adjusted to meet the second air-fuel ratio in the step d.

* * * * *